US006351917B1

(12) United States Patent
MacDonald et al.

(10) Patent No.: US 6,351,917 B1
(45) Date of Patent: Mar. 5, 2002

(54) STACKING CONNECTOR FOR PARTITIONS

(75) Inventors: Douglas B. MacDonald, Caledonia; Steven E. Sanders, Byron Center; James R. Dykstra, Grandville, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/364,746

(22) Filed: Jul. 30, 1999

(51) Int. Cl.[7] ..... E04H 1/00

(52) U.S. Cl. ..... 52/239; 52/220.7; 160/135; 160/351

(58) Field of Search ..... 52/239, 220.7, 52/49.1, 49.2, 36.1, 221; 160/135, 351; 403/326, 328, 329, 408.1

(56) References Cited

U.S. PATENT DOCUMENTS

| | | | | |
|---|---|---|---|---|
| 2,636,224 A | | 4/1953 | Murdoch et al. | |
| 2,777,172 A | | 1/1957 | Debbink | |
| 3,180,459 A | | 4/1965 | Liskey, Jr. | |
| 3,255,721 A | * | 6/1966 | Peterschmidt | 403/329 X |
| 3,591,993 A | * | 7/1971 | Reeves | 52/475 |
| 3,603,628 A | * | 9/1971 | Smith | 403/329 |
| 3,691,709 A | | 9/1972 | Ostborg | |
| 3,782,061 A | | 1/1974 | Minutoli et al. | |
| 3,845,601 A | * | 11/1974 | Kostecky | 403/326 X |
| 4,060,294 A | | 11/1977 | Hasworth et al. | |
| 4,435,927 A | | 3/1984 | Umezu et al. | |
| 4,535,577 A | | 8/1985 | Tensor et al. | |
| 4,567,698 A | | 2/1986 | Morrison | |
| 4,631,881 A | | 12/1986 | Charman | |
| 4,685,255 A | | 8/1987 | Kelley | |
| 4,694,621 A | | 9/1987 | Locke | |
| 4,716,698 A | | 1/1988 | Wison et al. | |
| 4,726,567 A | | 2/1988 | Greenberg | |
| 4,865,505 A | * | 9/1989 | Okada | 403/408.1 X |
| 4,891,922 A | | 1/1990 | Hozer et al. | |
| 4,951,550 A | * | 8/1990 | Ohki et al. | 403/326 X |
| 4,986,038 A | | 1/1991 | Backer | |
| 5,025,603 A | | 6/1991 | Johnson | |
| 5,038,539 A | | 8/1991 | Kelley et al. | |
| 5,056,577 A | | 10/1991 | DeLong et al. | |
| 5,058,347 A | | 10/1991 | Schuelke et al. | |
| 5,069,263 A | | 12/1991 | Edwards | |
| 5,070,666 A | | 12/1991 | Looman | |
| 5,155,955 A | | 10/1992 | Ball et al. | |
| 5,175,969 A | | 1/1993 | Knauf et al. | |

(List continued on next page.)

OTHER PUBLICATIONS

Exhibit A is a Steelcase Partition System in public use at least as early as Jul. 29, 1998.

*Primary Examiner*—Bruce A. Lev
(74) *Attorney, Agent, or Firm*—Price, Heneveld, Cooper, DeWitt & Litton

(57) ABSTRACT

A partition frame assembly includes a lower partition frame having at least two elongated lower structural uprights. The lower partition frame defines an upper edge, and includes an upwardly-opening utilities channel extending adjacent the upper edge to permit lay-in of utility lines along the upper edge of the lower partition frame. An upper extension frame is positioned above the lower partition frame, and includes at least two elongated upper structural uprights, each of which is in vertical registry with the lower structural uprights. The partition frame includes first and second brackets, each of which rigidly interconnect a selected upper structural upright to a selected lower structural upright. Each bracket has a lower end rigidly interconnected with the selected lower structural upright, and an upper end rigidly interconnected with the selected upper structural upright. Each bracket has an upwardly-opening cut-out therethrough that is positioned in alignment with the utilities channel to permit routing of utility lines along the utilities channel and through the brackets.

24 Claims, 5 Drawing Sheets

U.S. PATENT DOCUMENTS 5,277,007 A 1/1994 Hellwig et al.
5,287,666 A 2/1994 Frascaroli et al.
5,341,615 A 8/1994 Hodges et al.
5,394,658 A 3/1995 Schreiner et al.
5,394,668 A 3/1995 Lim
5,412,913 A 5/1995 Daniels et al.
5,490,357 A 2/1996 Lin
5,561,960 A 10/1996 Minnick et al.
5,689,924 A 11/1997 Mason
5,737,893 A 4/1998 Rossiter et al.
5,758,987 A * 6/1998 Frame et al. ..... 403/298
5,787,675 A 8/1998 Futagi
5,806,258 A 9/1998 Miedema et al.
5,875,594 A 3/1999 Hellwig et al.
5,881,500 A 3/1999 Latino et al.
5,899,035 A * 5/1999 Waalkes et al. ..... 52/239
5,913,787 A 6/1999 Edwards
5,918,433 A 7/1999 Reuter et al.
6,009,675 A * 1/2000 Waalkes et al. ..... 52/239
6,009,676 A * 1/2000 Feldpausch et al. ..... 52/239
6,098,358 A * 8/2000 Waalkes et al. ..... 52/239

* cited by examiner

STACKING CONNECTOR FOR PARTITIONS

CROSS-REFERENCES TO RELATED APPLICATIONS

The present application is related to commonly assigned, U.S. patent application Ser. No. 09/060,913, now U.S. Pat. No. 6,098,358, entitled KNOCK-DOWN PORTABLE PARTITION SYSTEM, and commonly assigned, U.S. patent application Ser. No. 08/914,664, now U.S. Pat. No. 6,009,675, entitled KNOCK-DOWN PORTABLE PARTITION SYSTEM, commonly assigned, U.S. patent application Ser. No. 08/856,995, now U.S. Pat. No. 5,899,035, entitled KNOCK-DOWN PORTABLE PARTITION SYSTEM, and commonly assigned co-pending patent application Ser. No. 09/293,196, filed on Apr. 16, 1999, entitled STACKING BRACKET FOR PARTITIONS, each of which is hereby incorporated herein by reference.

BACKGROUND OF THE INVENTION

The present invention relates to office partition panel systems, and in particular to a connector for stacking partitions that provides quick and easy on-site assembly.

The efficient use of building floor space is an ever-growing concern, particularly as building costs continue escalating. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as worksurfaces, overhead cabinets, shelves, etc., and are generally known in the office furniture industry as "systems furniture." Such partition panels have an acoustical sound-absorbing configuration to promote a quiet, pleasant work environment.

In an effort to accommodate the changing requirements of the users, "stacking" panel systems have been developed to permit the height of a partition panel to be extended if required for a particular application. Known stacking panel systems may be difficult to install, and further, the stacking panel may interfere with the routing of communications and/or power lines through the partition system. Accordingly, a stacking panel system alleviating the above-identified problems is desired.

SUMMARY OF THE INVENTION

One aspect of the present invention is a partition frame assembly including a lower partition frame. The lower partition frame has at least two elongated lower structural uprights, and the lower partition frame defines an upper edge. The lower partition frame further includes an upwardly-opening utilities channel extending adjacent the upper edge to permit lay-in of utility lines along the upper edge of the lower partition frame. An upper extension frame is positioned above the lower partition frame, and includes at least two elongated upper structural uprights, each of which is in vertical registry with the lower structural uprights. The partition frame includes first and second brackets, each of which rigidly interconnects a selected upper structural upright to a selected lower structural upright. Each bracket has a lower end rigidly interconnected with the selected lower structural upright, and an upper end rigidly interconnected with the selected upper structural upright. Each bracket has an upwardly-opening cut-out therethrough that is positioned in alignment with the utilities channel to permit routing of utility lines along the utilities channel and through the brackets.

Another aspect of the present invention is a partition frame assembly including a lower partition frame including at least two elongated lower structural uprights. The lower partition frame defines an upper edge, and includes an upwardly-opening utilities channel extending adjacent the upper edge to permit lay-in of utilities along the upper edge of the lower partition frame. An upper extension frame is positioned above the lower partition frame, and includes at least two elongated upper structural uprights, each of which is in vertical registry with the lower structural uprights. The partition frame assembly includes a pair of brackets, each of which rigidly interconnects a selected lower structural upright with a selected upper structural upright. Each bracket is generally Y-shaped, and defines an upper portion having a pair of upwardly extending legs with a clearance opening therebetween. Each of the upwardly extending legs is rigidly interconnected with a selected upper structural upright with the clearance opening positioned in alignment with the utilities channel to permit routing of utility lines through each of the brackets. Each Y-shaped bracket has a lower portion rigidly interconnected with a selected one of the lower structural uprights to rigidly interconnect the upper partition frame to the lower partition frame.

Yet another aspect of the present invention is a bracket for rigidly interconnecting an extension panel frame to a base panel frame. The bracket includes an elongated rigid body having a central portion and first connectors on an upper portion adapted to rigidly interconnect to an extension panel frame. The rigid body also has a second connector on a lower portion that is adapted to rigidly interconnect the bracket to a base panel frame. The bracket also includes a catch extending transversely from the central portion of the rigid body. The catch is shaped to engage a base panel frame to support the bracket and permit securing the second connectors to a base panel frame.

Yet another aspect of the present invention is a method of interconnecting an extension panel frame to a lower panel frame of the type having at least one utility line extending within an upwardly-opening utility trough positioned along an upper edge of the lower panel frame. The method includes providing a bracket having a lower portion and an upwardly-opening clearance opening therethrough. The utility line is shifted out of the utility trough, and placed in the clearance opening through the bracket. The clearance opening is aligned with the utility trough, and the utility line is shifted into the utility trough. The bracket is secured to the lower panel frame, and the extension panel is positioned above the lower panel frame. The extension panel is secured to the bracket to interconnect the extension panel frame and the lower panel frame.

These and other advantages of the invention will be further understood and appreciated by those skilled in the art by reference to the following written specification, claims, and appended drawings.

DETAILED DESCRIPTION OF PREFERRED EMBODIMENTS

Figure 1:
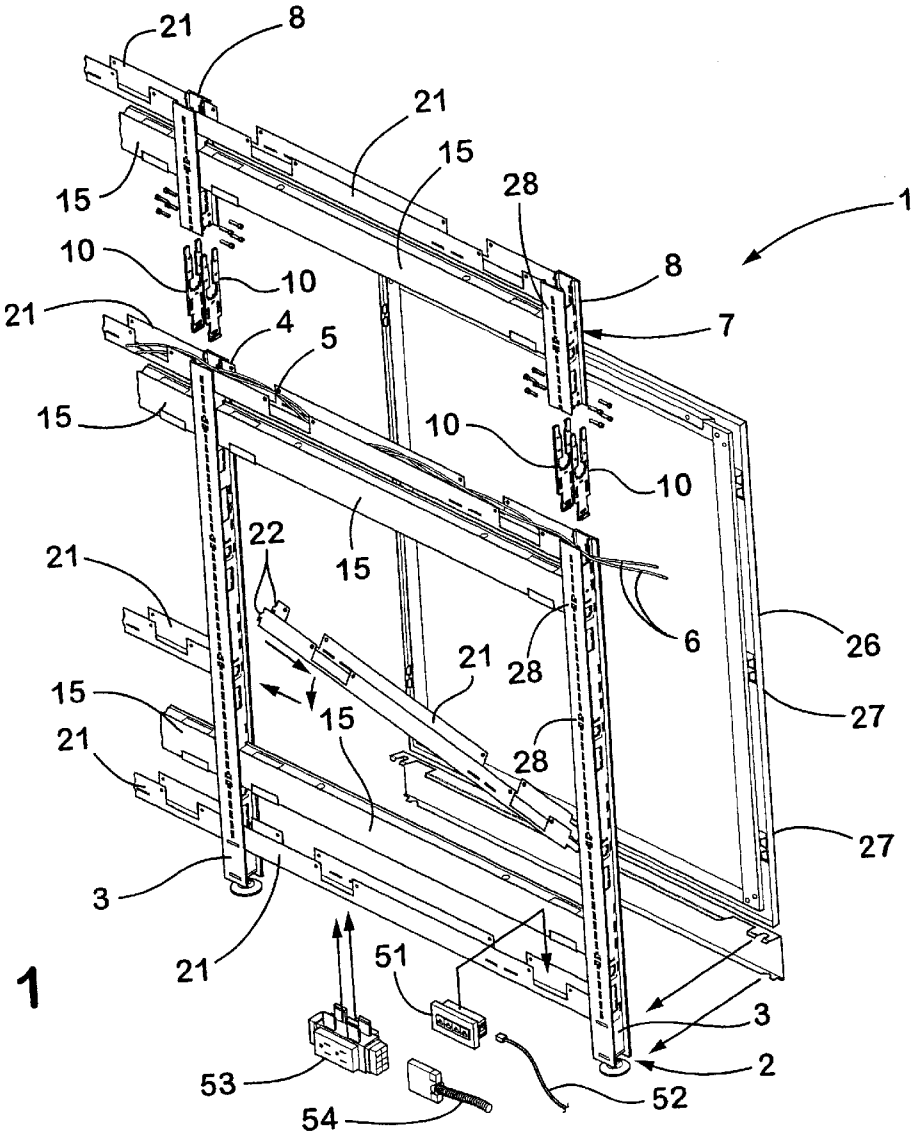
FIG. 1 is a fragmentary, perspective view of a stacking partition system embodying the present invention, which includes a base panel, an extension panel, and connector brackets.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
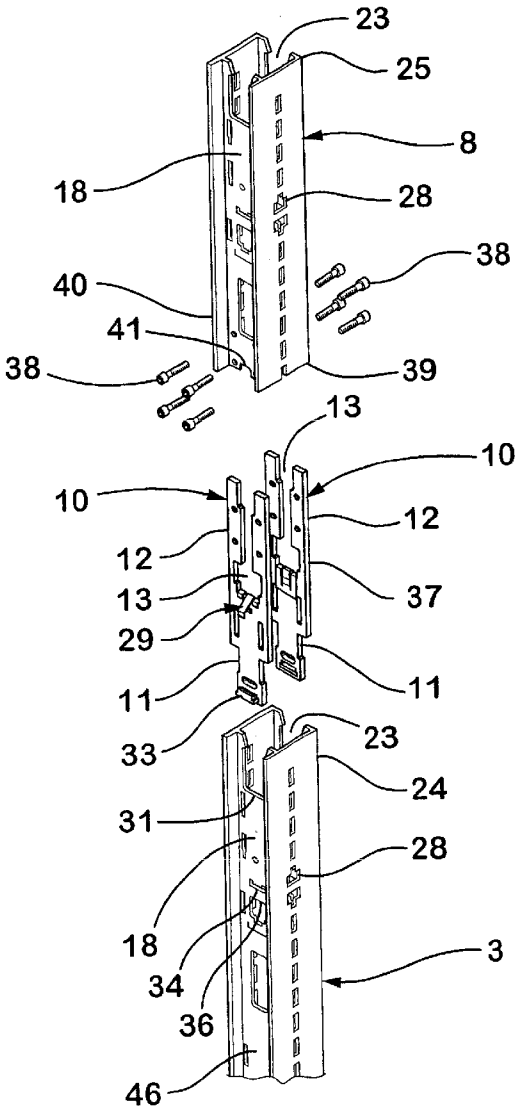
FIG. 2 is a fragmentary, perspective view of a pair of connector brackets, a base post, and an extension post of FIG. 1.

The reference numeral 1 (FIG. 1) generally designates a partition frame assembly embodying the present invention, which is particularly designed for use in open office plans, and other similar settings and environments. In the illustrated example, partition frame assembly 1 includes a lower partition frame 2 includes at least two elongated lower structural uprights, such as posts 3. The lower partition frame 2 defines an upper edge 4, and includes an upwardly-opening utilities channel 5 extending adjacent the upper edge 4 to permit lay-in of utility lines 6, such as power or data lines along the upper edge 4 of the lower partition frame 2. An upper extension frame 7 is positioned above the lower partition frame 2, and includes at least two elongated upper structural uprights, such as extension posts 8, each of which is in vertical registry with a lower post 3. At least one bracket 10 rigidly interconnects each extension post 8 to a selected lower post 3. In the illustrated embodiment, a pair of brackets 10 interconnect each extension post 8 to a lower post 3. With further reference to FIG. 2, each bracket 10 has a lower end 11 that is rigidly interconnected with a selected lower post 3, and an upper end 12 rigidly interconnected with a selected extension post 8. Each bracket 10 includes an upwardly-opening cut-out 13 through the bracket 10 positioned in alignment with the utilities channel 5 when in the installed position to permit routing of utility lines 6 along the utilities channel 5 and through the brackets 10.

Figure 3:
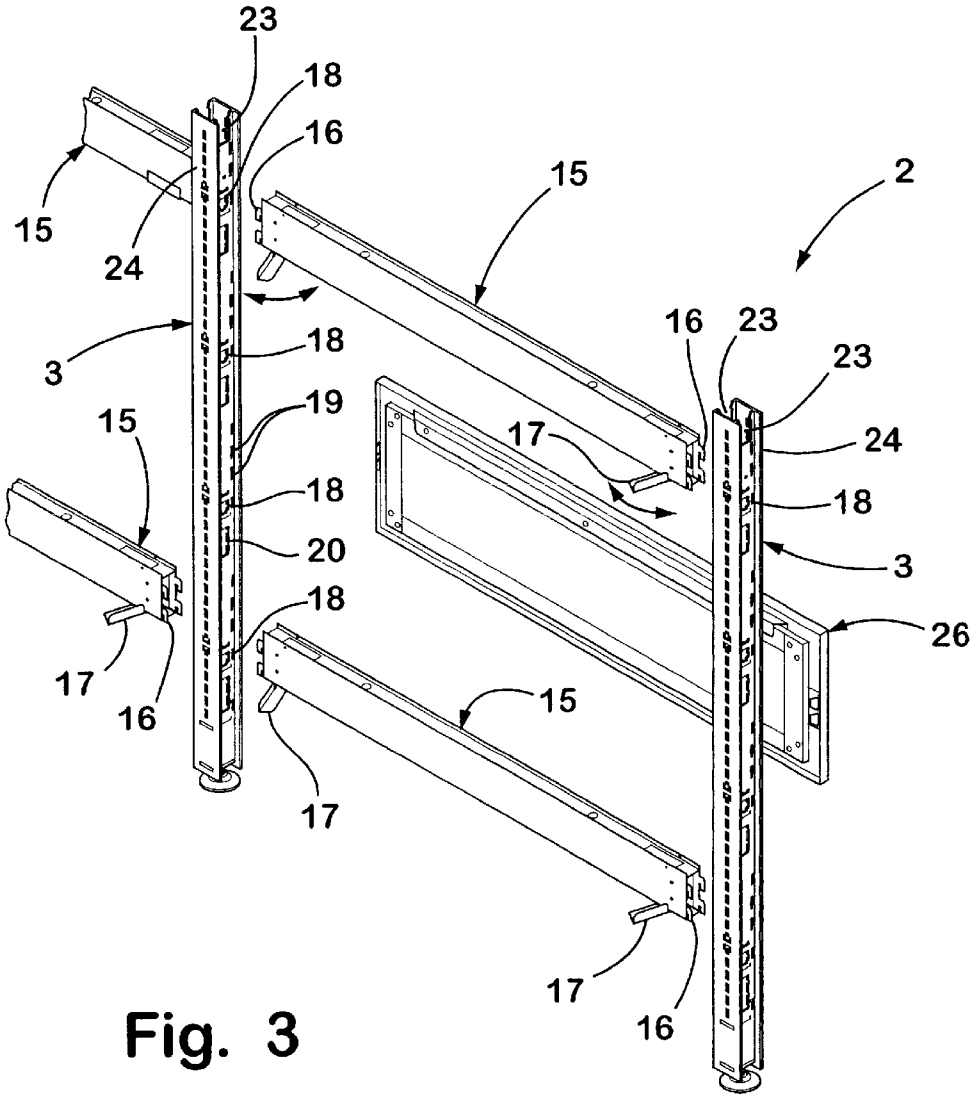
FIG. 3 is an exploded, fragmentary, perspective view of the base partition frame of FIG. 1.

As described in more detail in the above-identified co-pending U.S. patent application Ser. No. 08/856,995 entitled KNOCK-DOWN PORTABLE PARTITION SYSTEM, the partition frame 2 (FIG. 3) includes upper and lower beams 15 that extend between the posts 3. Each beam 15 includes four hooks 16 that are received within the slots or apertures 19 of connection ports 18. After the hooks 16 are received within the apertures 19, the ends of the beam are shifted downwardly to engage the book 16, and a movable lock 17 is rotated. An end portion of the lock 17 is received within opening 20 of connection port 18, thereby preventing disengagement of hooks 16. The knock-down construction of frame 2 permits quick and simple on-site assembly of the partition frame assembly.

The partition frame 2 may include a plurality of utility troughs 21 (FIG. 1). Utility troughs 21 have an upwardly-opening U-shape for routing of utility lines 6. Each utility trough 21 includes hooks 22 at one or more ends of the utility trough 21 that are received within apertures 19 to support the utility trough. A utility trough 21 can be placed above the upper beam 15, thereby forming the upper edge 4 of the lower partition frame 2 and providing utility channel 5. The upper end 24 of each post 3 has an upwardly-opening cut-out 23 that aligns with the utility trough 21 to permit uninterrupted lay-in of utility lines 6 between adjacent partition frames 2 along channel 5. One or more data receptacles 51 and associated data lines 52 may be mounted to the utility troughs 51 to provide for telephones and the like. One or more power receptacles 53 and associated power lines 54 may also be connected to the utility troughs 21 to provide electrical power for the various electrical devices in the office space.

With reference to FIG. 2, extension posts 8 have substantially the same construction as lower posts 3, and include one or more connection ports 18, and a cut-out 23 at the upper end 25 to permit lay-in of utility lines along the upper edge of the extension frame 7. The upper extension frame 7 includes a pair of extension posts 8, and at least one beam 15 to rigidly interconnect the extension posts 8. Extension frame 7 may also include one or more utility troughs 21 for routing of the utility lines 6. In addition, one or more cover panels 26 are mounted to both the upper and lower partition frames by clips 27 that are received in openings 28 of the lower posts 3 and extension posts 8.

Figure 6:
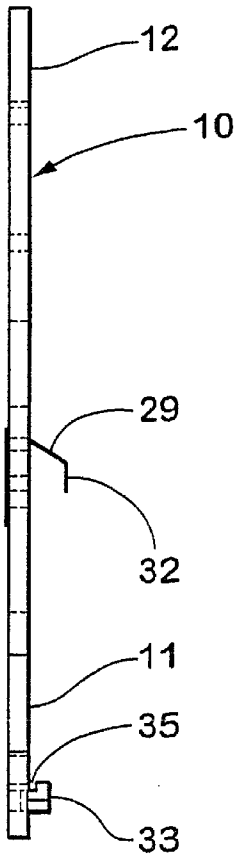
FIG. 6 is a side elevational view of the connector bracket of FIG. 4.
Figure 5:
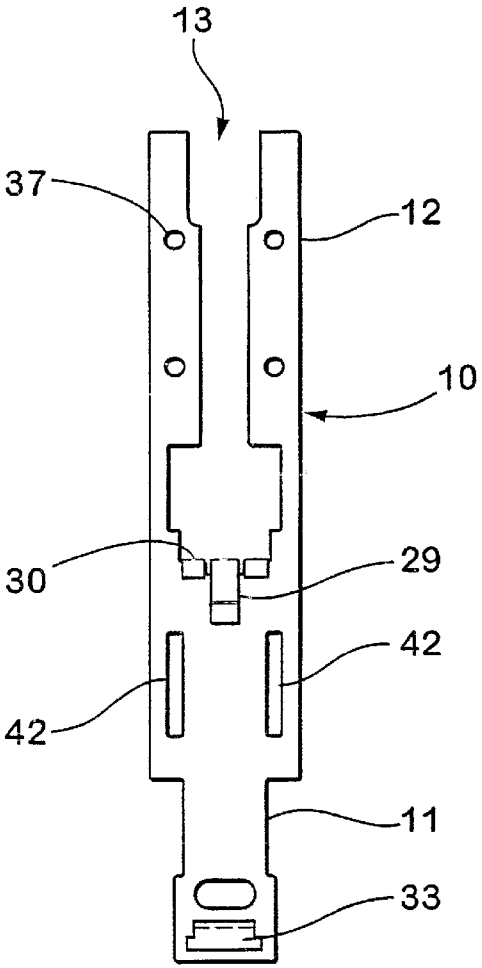
FIG. 5 is a front elevational view of the connector bracket of FIG. 4.
Figure 4:
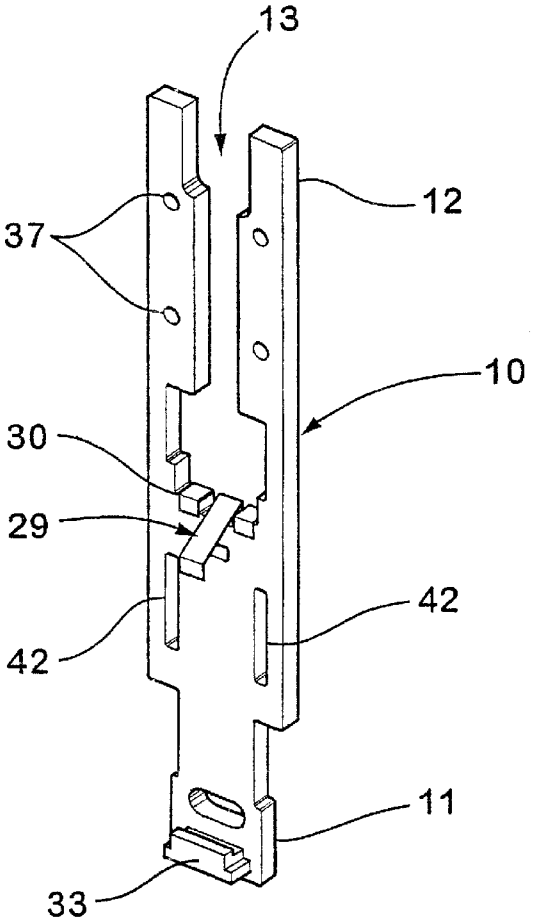
FIG. 4 is a perspective view of the connector bracket of FIG. 1.

With further reference to FIGS. 4–6, bracket 10 includes a clip 29 that is received on the lower edge 30 of cut-out 13. During installation of bracket 10, the bracket 10 is inserted into the open upper end 24 of lower post 3, and the downwardly extending leg 32 of clip 29 engages the lower, horizontal edge 31 of cut-out 23 of post 3 to prevent the bracket 10 from falling into the lower post 3. An upwardly extending hook-like portion 33 at the lower end 11 of bracket 10 is then shifted outwardly through large opening 34 of connection port 18. Hook 33 has width that is substantially equal to the width of opening 34, such that hook 33 fits snuggly against the side edges of opening 34 to prevent side-to-side motion of lower end 11 of bracket 10. The bracket 10 is then shifted upward slightly, such that the upper edge 36 of opening 34 is received within the gap 35 formed by the hook portion 33 of bracket 10. Leg 32 of clip 29 has sufficient flexibility to permit downward shifting of bracket 10 during installation, and also biases the bracket 10 upwardly, such that the edge 36 of opening 34 in post 3 remains in the gap 35 formed by hook 33 of bracket 10. After inserting a pair of brackets 10 into the open upper end 24 of lower post 3, the extension post 8 is positioned above the post 3, and shifted downwardly, such that the upper ends 12 of brackets 10 are received in the open lower end 39 of extension post 8. Bolts 38 are then inserted through the openings 40 of extension posts 8, and threaded into the threaded openings 37 in the upper end 12 of bracket 10. It is anticipated that, during assembly, a pair of the extension posts 8 would be interconnected by a structural beam 15 to form the upper extension frame 7, which would then be installed as a unit on a pair of the lower posts 3. Utility lines 6 may be installed in the utility channel 5 of the lower partition frame 2, such that the utility lines 6 are first grasped, and pulled out of the cut-out 23 of post 3 during installation. The brackets 10 are then inserted into the open upper end 24 of post 3 as described above, and the utility lines 6 are then placed in the cut-out 13 of bracket 10 and positioned in alignment with the utility channel 5 formed by the upper utility trough 21. Alternately, the utility lines 6 may be placed in the cut-out 13 of bracket 10 prior to inserting the bracket 10 into the open upper end 24 of post 3. The extension post 8 is then installed as described above. Extension posts 8 may include a cut-out 41 at the lower end 39 to provide additional clearance for utility lines 6. Bracket 10 preferably includes a pair of elongated clearance openings 42 that provide clearance for the hooks 16 of a beam 15 that is positioned directly below the upper utility trough 21.

Figure 7:
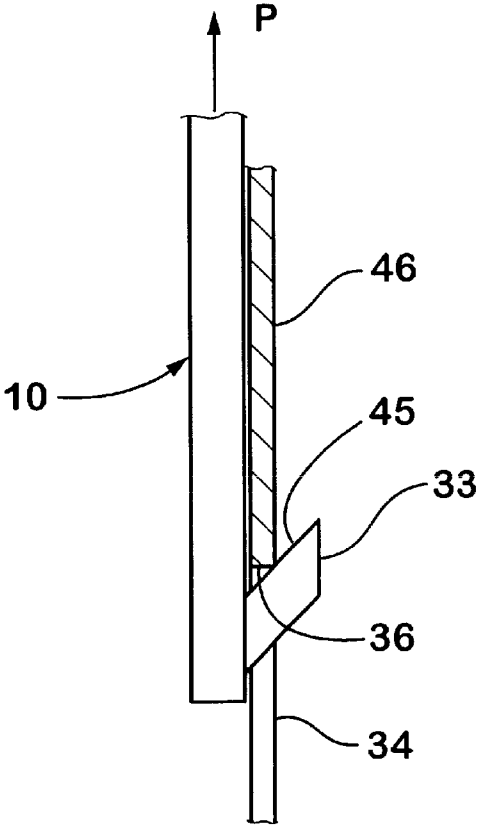
FIG. 7 is a side elevational view of the lower portion of another embodiment of the connector bracket.

As illustrated in FIG. 7, in an alternate embodiment, hook 33 includes a tapered, or sloped upper surface 45 that engages the upper edge 36 of opening 34 in sidewall 46 of post 3. The angled surface 35 ensures that the lower end 11 of the bracket is biased into contact with the sidewall 46 due to the upward force "P" on the bracket 10 generated by the leg 32 of clip 29.

Figure 8:
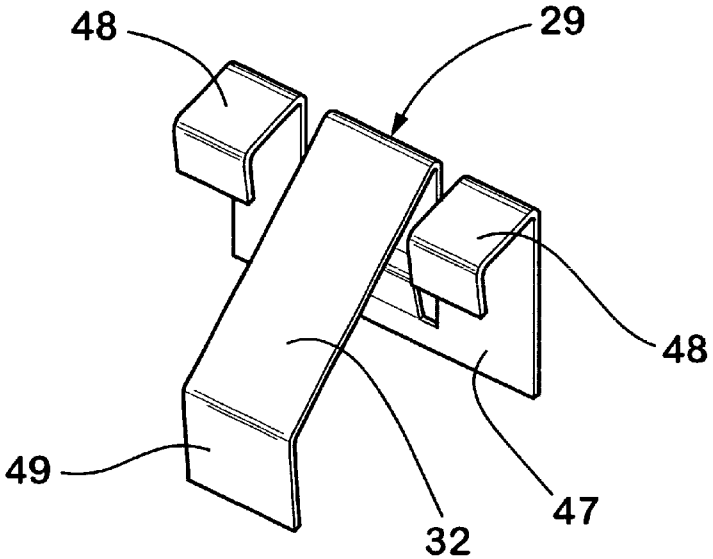
FIG. 8 is a perspective view of the connector clip of FIG. 4.

With reference to FIG. 8, clip 29 is formed from a relatively thin spring steel, and has a main body portion 47, and a pair of U-shaped retainers 48 that secure the clip 29 to the lower edge 30 of cut-out 13 of bracket 10. Leg 32 extends downwardly at angle relative to the plane formed by bracket 10, and includes an end portion 49 that extends approximately parallel to the plane of bracket 10 to ensure that the clip 29 does not inadvertently disengage from the lower edge 31 of cut-out 23 of lower post 3.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition frame assembly, comprising:

a lower partition frame including at least two elongated lower structural uprights, said lower partition frame defining an upper edge, and including an upwardly-opening utilities channel extending adjacent said upper edge to permit lay-in of utility lines along said upper edge of said lower partition frame;

an upper extension frame positioned above said lower partition frame and including at least two elongated upper structural uprights, each of which is in vertical registry with said lower structural uprights; and first and second brackets, each rigidly interconnecting a selected one of said upper structural uprights to a selected one of said lower structural uprights, each bracket having a lower end rigidly interconnected with said selected lower structural upright and an upper end rigidly interconnected with said selected upper structural upright, each bracket having an upwardly-opening cut-out therethrough positioned in alignment with said utilities channel to permit routing of utility lines along said utilities channel and through said brackets.

2. The partition frame assembly set forth in claim 1, wherein:

said bracket includes a pair of upwardly extending legs with said upwardly-opening cut-out therebetween, each said leg including a connector rigidly interconnecting each said leg with said selected upper structural upright.

3. The partition frame assembly set forth in claim 2, wherein:

each bracket includes a transversely extending catch engaging said selected lower structural upright and vertically positioning each bracket relative to each selected lower structural upright.

4. The partition frame assembly set forth in claim 3, wherein:

each lower structural upright has a sidewall with an aperture therethrough defining an edge around a perimeter of said aperture; and each bracket having an upwardly-opening hook portion adjacent said lower end extending into said aperture and engaging said edge and securing said lower end to said lower structural upright.

5. The partition frame assembly set forth in claim 4, wherein:

each bracket includes an elongate body; and said hook portion includes an end extending at an angle relative to said elongate body to define a V-shaped catch surface, said edge of said aperture positioned within said V-shaped surface to secure said lower end of each said bracket to said selected lower structural upright.

6. The partition frame assembly set forth in claim 5, wherein:

each said transversely extending catch has a downwardly extending portion, an upper edge of each said selected lower structural upright received between said elongate body and said downwardly extending portion to position and support each said bracket on said selected lower structural upright.

7. The partition frame assembly set forth in claim 6, wherein:

said aperture in said lower structural upright defines a pair of spaced-apart side edges defining a width, said aperture further defining an upper edge extending between said side edges; and said hook portion defining side surfaces spaced-apart a distance approximately equal to said width, said side surfaces snuggly engaging said side edges to provide a tight fit between said side edges of said aperture.

8. The partition frame assembly set forth in claim 7, wherein:

said downwardly extending portion of said catch forms a downwardly-opening V-shape with said elongate body, said catch including an end portion extending from said downwardly extending portion approximately parallel to said elongate body.

9. The partition frame assembly set forth in claim 8, including:

third and fourth brackets that are substantially identical to said first and second brackets, respectively, said third and fourth brackets each rigidly interconnecting a selected one of said upper structural uprights to a selected one said lower structural uprights, such that each upper structural upright is interconnected with a lower structural upright by a pair of said brackets.

10. A partition frame assembly, comprising:

a lower partition frame including at least two elongated lower structural uprights, said lower partition frame defining an upper edge, and including an upwardly-opening utilities channel extending adjacent said upper edge to permit lay-in of utilities lines along said upper edge of said lower partition frame;

an upper extension frame positioned above said lower partition frame and including at least two elongated upper structural uprights, each of which is in vertical registry with said lower structural uprights; and a pair of brackets, each rigidly interconnecting a selected lower structural upright with a selected upper structural upright, each bracket being generally Y-shaped and defining an upper portion having a pair of upwardly extending legs with a clearance opening therebetween, each said upwardly extending leg rigidly interconnected to said selected upper structural upright with said clearance opening positioned in alignment with said utilities channel to permit routing of utility lines through each said bracket, each said Y-shaped bracket having a lower portion rigidly interconnected with a selected one of said lower structural uprights to rigidly interconnect said upper partition frame to said lower partition frame.

11. The partition frame assembly set forth in claim 10, wherein:

each said bracket includes a transversely extending catch that engages said lower structural upright and supports each said bracket on said lower structural upright.

12. The partition frame assembly set forth in claim 11, wherein:

said transversely extending catch is hook-shaped.

13. The partition frame assembly set forth in claim 10, wherein:

each said lower structural upright includes an aperture; and said lower portion of said bracket includes an upwardly-opening hook-shaped portion received within said aperture to secure said lower portion of said bracket to said lower structural upright.

14. The partition frame assembly set forth in claim 13, wherein:

said aperture defines an upper edge; and said hook-shaped portion of said bracket engages said upper edge.

15. The partition frame assembly set forth in claim 10, wherein:

said lower partition frame includes vertically spaced-apart upper and lower beams extending between said structural uprights and rigidly interconnecting said structural uprights; and said upper extension frame includes at least one beam extending between said upper structural uprights and rigidly interconnecting said structural uprights.

16. The partition frame assembly set forth in claim 15, wherein:

each said beam includes quick connectors positioned on opposite ends thereof and rigidly, yet releasably interconnecting said beams with said structural uprights.

17. The partition frame assembly set forth in claim 16, wherein:

said utility channel is formed by a drop-in utility trough having a pair of hooks at opposite ends that engage said lower structural uprights and support said utility trough between said lower structural uprights.

18. The partition frame assembly set forth in claim 17, wherein:

said catch is positioned on a lower edge of said clearance opening.

19. The partition frame assembly set forth in claim 18, wherein:

each said catch has a downwardly-opening V-shape.

20. A method of interconnecting an extension panel frame to a lower panel frame of the type having at least one utility line extending within an upwardly-opening utility trough positioned along an upper edge of the lower panel frame, said method comprising:

providing a bracket having a lower portion and an upwardly-opening clearance opening therethrough;

shifting said utility line out of said utility trough;

placing said utility line in said clearance opening;

aligning said clearance opening with said utility trough;

shifting said utility line into said utility trough;

securing said bracket to said lower panel frame;

positioning said extension panel above said lower panel frame; and securing said extension panel to said bracket to interconnect said extension and lower panel frames.

21. The method set forth in claim 20, wherein:

said extension panel is secured to said bracket with threaded fasteners.

22. The method set forth in claim 21, wherein:

said bracket includes an upwardly-opening hook at a lower end thereof; and said hook is placed in an aperture in said lower panel frame and shifted upwardly to receive an upper edge of said aperture in said hook.

23. The method set forth in claim 22, wherein:

said bracket includes a catch that engages said lower panel frame and supports said bracket on said lower panel frame.

24. The method set forth in claim 23, wherein:

said clearance opening is aligned with said utility trough prior to placing said utility line in said clearance opening.

* * * * *